United States Patent [19]

Rice

[11] Patent Number: 4,538,807

[45] Date of Patent: Sep. 3, 1985

[54] TORSO BUILDING EXERCISE MACHINE

[75] Inventor: Max Rice, San Francisco, Calif.

[73] Assignee: The Max Rice Corporation, Seattle, Wash.

[21] Appl. No.: 628,485

[22] Filed: Jul. 6, 1984

[51] Int. Cl.[3] ..... A63B 23/02

[52] U.S. Cl. ..... 272/146; 272/134

[58] Field of Search ..... 272/146, 93, 118, 113, 272/134

[56] References Cited

U.S. PATENT DOCUMENTS

| | | | |
|---|---|---|---|
| D. 231,242 | 4/1974 | Herrmann . | |
| 2,530,921 | 11/1950 | Tougas . | |
| 2,757,388 | 8/1956 | Chisholm | 272/146 X |
| 3,100,639 | 8/1963 | Bonewitz . | |
| 3,384,369 | 5/1968 | Rumell . | |
| 3,659,844 | 5/1972 | Cummins . | |
| 3,841,627 | 10/1974 | Vetter . | |
| 3,911,907 | 10/1975 | Smith, Jr. . | |
| 3,936,047 | 2/1976 | Brandt et al. . | |
| 4,026,279 | 5/1977 | Simjian . | |
| 4,077,626 | 3/1978 | Newman . | |
| 4,132,405 | 1/1979 | Asher . | |
| 4,153,244 | 5/1979 | Tauber, Jr. . | |
| 4,220,329 | 9/1980 | Agyagos . | |
| 4,305,579 | 12/1981 | Rice . | |
| 4,313,603 | 2/1982 | Simjian . | |
| 4,385,761 | 5/1983 | Rice . | |
| 4,391,441 | 7/1983 | Simjian . | |
| 4,436,513 | 3/1984 | Darby | 272/146 X |

*Primary Examiner*—Richard J. Apley
*Assistant Examiner*—Robert W. Bahr
*Attorney, Agent, or Firm*—Graybeal & Cullom

[57] ABSTRACT

One embodiment of the present invention is a torso building exercise machine including the following elements: (a) a stationary base; (b) a horizontally disposed rotatable turntable mounted on the base, the turntable having a single degree of freedom about its vertical axis; (c) posts for holding adjustable weights located near the periphery of the turntable; and (d) an upright stationary stanchion mounted on the base, the stanchion carrying a headrest and horizontal handholds in curved array at various vertical levels and selectively grippable by a person while performing various twisting exercises on the turntable.

A second embodiment of the present invention is a torso building exercise machine including the following elements: (a) a stationary base; (b) a horizontally disposed rotatable turntable mounted on the base, the turntable having a single degree of freedom about its vertical axis; (c) multiple tank-like compartments for holding an adjustable amount of a fluid located near the periphery of the turntable; and (d) an upright stationary stanchion mounted on the base, the stanchion carrying an array of horizontal handholds at various vertical levels and selectively grippable by a person while performing various twisting exercises on the turntable.

16 Claims, 6 Drawing Figures

TORSO BUILDING EXERCISE MACHINE

BACKGROUND OF THE INVENTION

1. Field of the Invention

The present invention relates to exercise machines, and in particular to an improved torso building exercise machine. Anatomically, the majority of human torso muscles used in athletic endeavors are positioned diagonally with corresponding diagonal lines of pull. Because of this diagonal relationship, resistance exercises in which movements follow the natural line of these muscles are more effective. Exercises performed on the present invention involve diagonal-rotational movements which span a greater range of motion and use more muscle groups than most trunk development exercises. Exercise machines according to the present invention train the torso for muscle power through the amount of weight used in the exercise and the speed at which it is performed.

2. Description of the Prior Art

The prior art includes many exercise machines including the following:

Cummins U.S. Pat. No. 3,659,844 discloses a machine for exercising the human body muscle system having a platform on which the user stands and which is mounted to swivel about a vertical pivot and at the same time to rock or see-saw about a central horizontal pivot. The rocking action is resisted by springs. The rocking load may be increased by attaching weights to the platform. A handlebar support is provided to be grasped by the user standing on the platform. Parallel handrails on opposite sides of the platform are adjustable to various positions.

Rice U.S. Pat. No. 4,305,579 discloses an apparatus upon which a person can do various exercises. The apparatus includes a stationary base having two posts with handgrips, a rotatable platform between the two posts, adjustable weights upon the platform, two rotatable inclined pads stationarily located on the platform for standing upon, and a head brace supported on the two posts. In one embodiment, a pull cord is pulled upwardly from the center of the platform for causing it to rotate.

Rice U.S. Pat. No. 4,385,761 discloses an exercise apparatus that is designed particularly for therapeutic purposes. The apparatus includes a rotatable turntable on a stationary base, a short post mounted at the center of the turntable, and either a rotatable seat or a horizontal board forming a bed or table supported on the short post. Two posts with handgrips are mounted on the base for being grasped by the user so as to twist himself on the device. In one embodiment, a pull rope is tied to the turntable and passed through a pulley mounted on the base for hand rotating the turntable.

SUMMARY OF THE INVENTION

One embodiment of the present invention is a torso building exercise machine including the following elements: (a) a stationary base; (b) a horizontally disposed rotatable turntable mounted on the base, the turntable having a single degree of freedom about its vertical axis; (c) posts for holding adjustable weights located near the periphery of the turntable; and (d) an upright stationary stanchion mounted on the base, the stanchion carrying an array of horizontal handholds at various vertical levels and selectively grippable by a person while performing various twisting exercises on the turntable.

A second embodiment of the present invention is a torso building exercise machine including the following elements: (a) a stationary base; (b) a horizontally disposed rotatable turntable mounted on the base, the turntable having a single degree of freedom about its vertical axis; (c) multiple tank-like compartments for holding an adjustable amount of fluid located near the periphery of the turntable; and (d) an upright stationary stanchion mounted on the base, the stanchion carrying an array of horizontal handholds at various vertical levels and selectively grippable by a person while performing various twisting exercises on the turntable.

DESCRIPTION OF THE PREFERRED EMBODIMENTS

As stated previously, the majority of human torso muscles are positioned diagonally with corresponding diagonal lines of pull. Because of this diagonal relationship, resistance exercises in which movements follow along the natural line of the muscles are more effective. Exercises performed on the present invention benefit the user by working the torso muscles along their anatomic alignment at speeds and resistances greater than are possible using traditional weight training techniques. Accordingly, the present invention trains the torso for muscle power through the amount of weight used when doing the exercise and through the speed at which it is performed.

Figure 1:
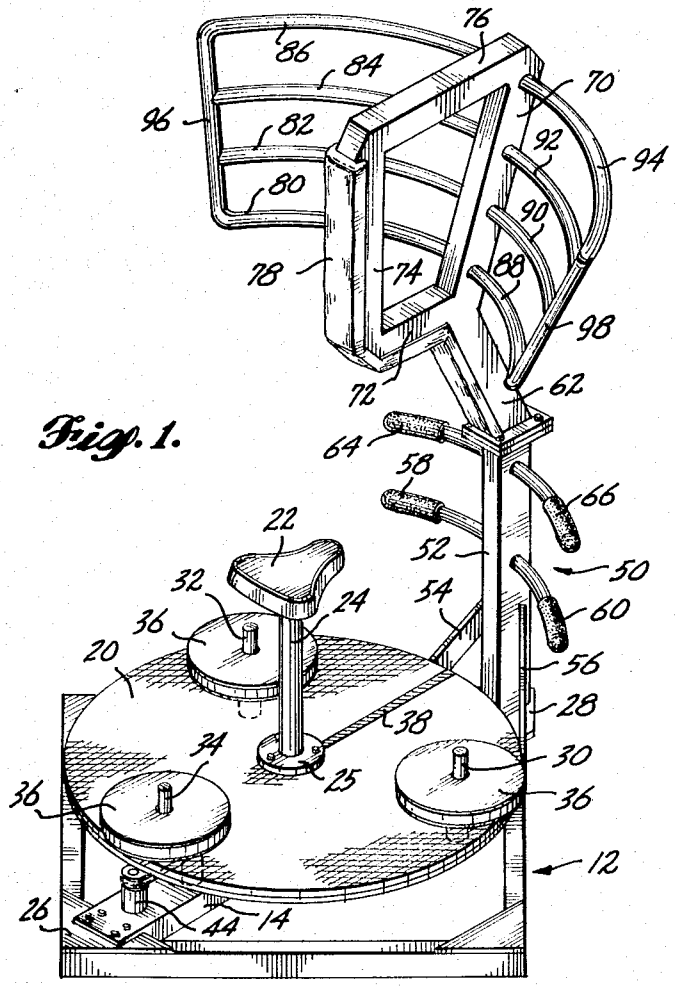
FIG. 1 is an isometric view of a torso building exercise machine constructed in accordance with the principles of the invention.

FIG. 1 is an isometric view of a torso building exercise machine 10 constructed in accordance with the principles of the invention. The stationary base consists of square base frame 12, which rests upon the floor or ground, and the diagonal cross member 14, which connects the two diagonally-opposed corners 26 and 28 of the base frame 12. A ball bearing support mounting 16 (FIG. 2 and FIG. 6) is secured on top of the cross member 14 at its mid-point. The lower end of a vertical support post 18 (FIG. 6) is journaled in the ball bearing support mounting 16. The upper end of the support post 18 is secured to the bottom of the circular, frictionless rotatable turntable 20 at its center. Thus, the support post 18 carries the weight of the horizontally disposed turntable 20 and the human user U thereon. The turntable 20 has a single degree of freedom about its vertical axis of rotation.

Optional seat 22 is fixedly mounted on vertical support post 24 which in turn is removably received in an annular support mounting 25 secured at the center of turntable 20. The seat 22 may be removed as in FIG. 2 or left in place as in FIG. 1 depending upon whether the user U desires to stand or sit while exercising. The seat 22 rotates with the turntable 20, but not independently of it.

Three vertical stub posts 30, 32, and 34 are placed in corresponding holes located near the periphery of the turntable 20 and located one hundred and twenty degrees apart. A selected number of barbell weights 36 or the like may be placed on the posts 30, 32, and 34 to adjustably increase the weight and therefore the inertial effect of the turntable 20 while maintaining a balanced distribution of weight on it. A radial line or pointer 38 on the surface of the turntable 20 indicates the starting point or 0° position for the turntable 20 when the pointer 38 points toward the upright stanchion 50 as shown in FIG. 1.

The two forward posts 32 and 36 optionally may have descending safety brake posts 40 and 42 (FIG. 3) which extend below the turntable 20. Upon rotation of the turntable 20, one of the brake posts 40 or 42 ultimately hits the safety brake cord 44 (FIG. 2) which is strung between the two vertical support posts 46 and 48. The support posts 46 and 48 are mounted on the cross member 24 near its corner 26. This arrangement of the safety brake cord 44 and the brake posts 40 and 42 permits the radial pointer 38 on the turntable 20 to rotate one hundred and twenty degrees from the starting point position in either a clockwise or counterclockwise direction. Limiting the turntable 20 to this amount of rotation prevents the user U from hyperextending himself while exercising on the machine.

Figure 2:
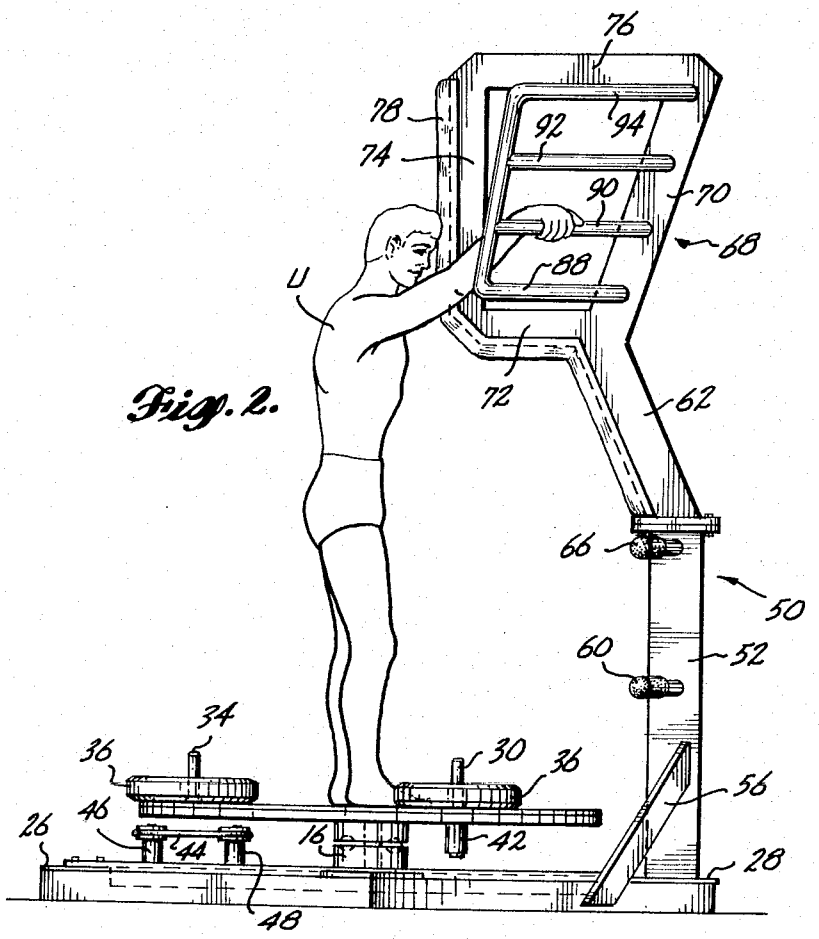
FIG. 2 is a side elevational view of the torso building exercise machine shown in FIG. 1 with the seat removed. A user is shown standing on the machine with his hands gripping selected handholds and with his forehead stabilized against the headrest.
Figure 3:
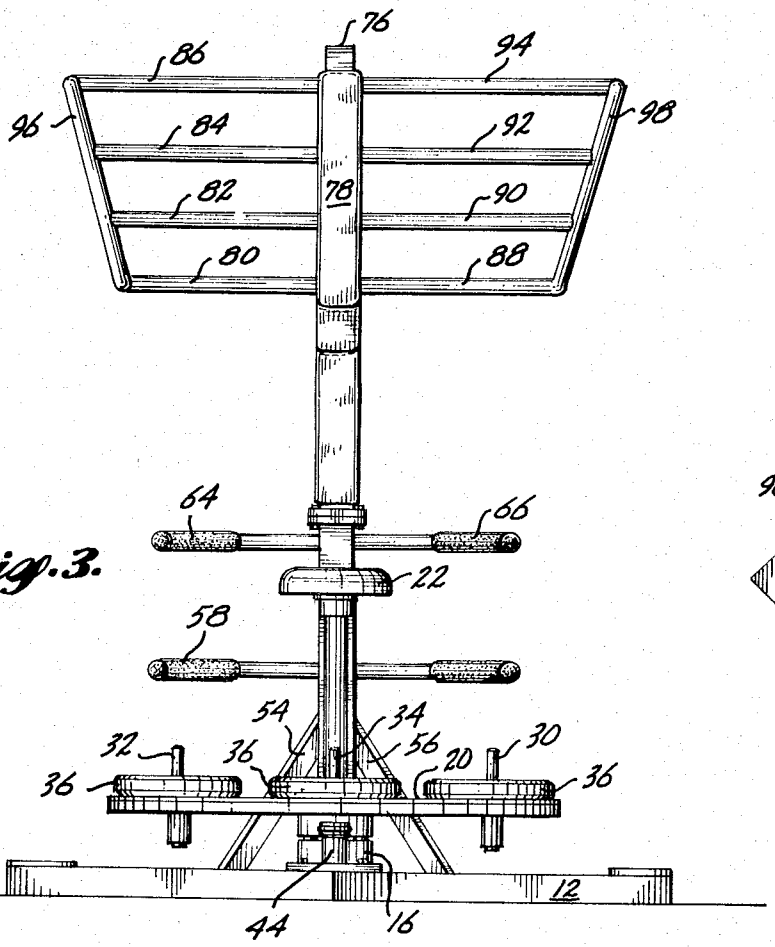
FIG. 3 is a rear elevational view of the torso building exercise machine shown in FIG. 1.

The upright stanchion 50 is mounted on the corner 28 of the base frame 12. The lower vertical section 52 of the stanchion 50 is perpendicular to the plane of the base frame 12 as shown in FIG. 2. Diagonal cross members 54 and 56 brace the lower section 52. Two curved, horizontally-disposed lower handholds 58 and 60 project away from and are rigidly mounted on the opposite sides of the lower section 52 near its center. The two curved, horizontally-disposed, intermediate handholds 64 and 66 project away from and are rigidly mounted on the opposite sides of the lower section 52 near its upper end.

The intermediate section 62 of the stanchion 50 is mounted on top of the lower section 52 and slants inwardly (as shown in FIG. 2) towards the user U and the vertical axis of rotation of the turntable 20.

Figure 4:
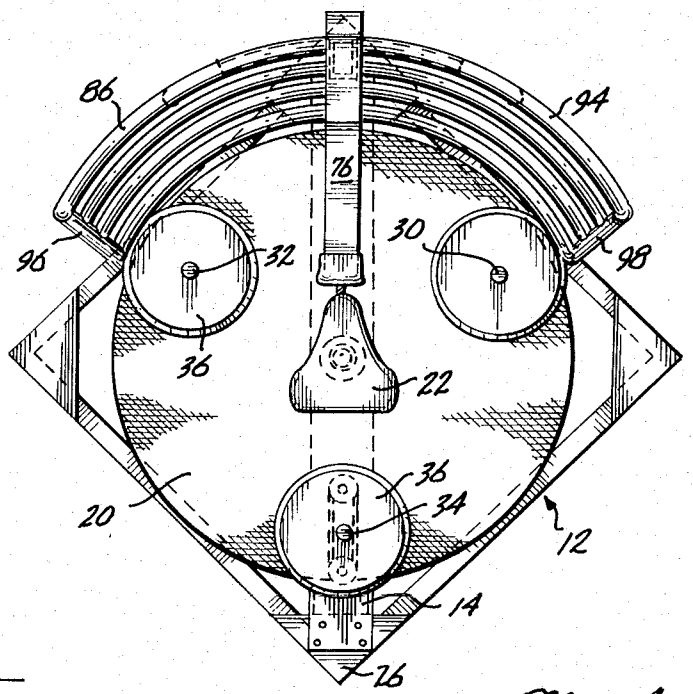
FIG. 4 is a top plan view of the torso building exercise machine shown in FIG. 1.

The upper section 68 of the stanchion 50 is a quadrilateral frame consisting of an outwardly-slanting rear frame member 70, a horizontally-disposed bottom frame member 72, a vertically-disposed front frame member 74, and a horizontally-disposed top frame member 76. The four curved, horizontally-disposed, upper handholds 80, 82, 84, and 86 project away from and are mounted on the left side of the rear frame member 70. The four curved, horizontally-disposed, upper handholds 88, 90, 92, and 94 project away from and are rigidly mounted on the right side of the rear frame member 70. In the preferred embodiment, the upper handholds 80–94 substantially occupy arcs of circles whose centers are concentric with the vertical axis of rotation of the rotatable turntable 20 and the arcs span about one hundred and twenty degrees, as shown in FIG. 4. The outer ends of the upper handholds 80, 82, 84, and 86 are interconnected by the brace member 96 and the outer ends of the upper handholds 88, 90, 92, and 94 are interconnected by the brace member 98. The braces 96 and 98 add rigidity and strength to the array of the upper handholds 80–94, and of themselves also provide handholds.

The intermediate section 62, the bottom frame member 72, and the front frame member 74 preferably but not necessarily have a foam rubber or the like cushion strip 78 mounted thereon facing toward the user U to provide a headrest for the user's forehead as shown in FIG. 2.

Figure 5:
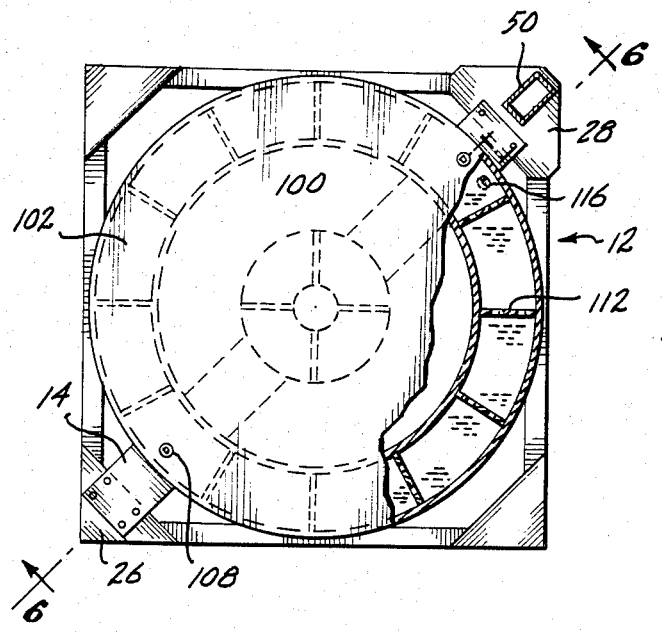
FIG. 5 is a top plan view of a second embodiment of a torso building exercise machine constructed in accordance with the principles of the invention with certain elements omitted from the drawing and with a fragmentary portion of the rotary turnable being shown in horizontal section.
Figure 6:
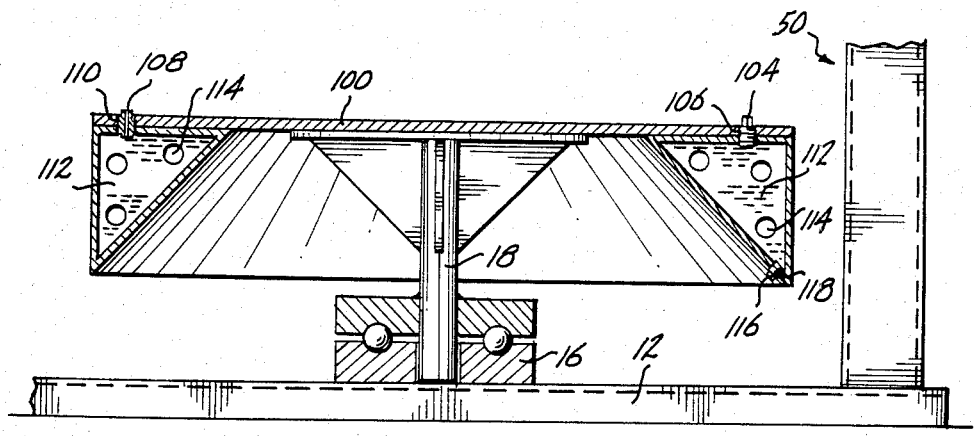
FIG. 6 is a vertical cross-sectional view of the second embodiment of the invention, taken substantially along line 6—6 of FIG. 5.

FIGS. 5 and 6 illustrate a second embodiment of the invention. In this second embodiment, the rotatable turntable 100 is constructed with multiple tank-like compartments 102 located near the periphery of the circular turntable 100. In other respects, the second embodiment of the invention is similar to the first embodiment described above. A selected amount of a liquid, such as water, is added to the compartments 102 to adjustably increase the inertia of the turntable 100. To add liquid to the compartments 102, plug 104 is removed and the liquid is added through inlet 106. Plug 108 is removed to allow the air displaced by the incoming liquid to escape through aperture 110. The sidewalls 112 of the compartments 102 have apertures 114 for passage of the liquid between adjacent compartments. The liquid may be removed from the compartments 102 by removing plug 116 and allowing the liquid to drain through outlet 118.

The ball bearing support mounting 16 (FIG. 6) used to support the rotary turntable 100 is suitably of the same type as used to support the rotary turntable 20 in the first embodiment of the invention.

The provision of a fixed head brace is an important feature of exercise machines according to the present invention. With the user's head pressed against the brace, the upper position of the spine is relatively fixed (and more so than if only "anchored" through hand grips and the user's arms and shoulders), which throws the exercise exertions of the user more directly into the user's torso, hips and legs. The upper torso is, by use of the head brace, stabilized at three points. The "main line" of the skeleton of a user is from head to toe, not necessarily through the arms and shoulders, and the head, when braced or fixed relative to the feet on the rotating turntable, affords a more effective exercising of such "main line" of the anatomy than is the case when the upper part of the body is anchored only by hand grips.

Using traditional weight-training techniques, the user cannot combine great loads and high speeds without the threat of serious injury. Thus, the torso building exercise machine 10 is safer than traditional forms of weight training because the user's spine is not loaded. Since all the weight is on the turntable 20 or 100, nothing is abnormally compressing the spine or the legs. The user is able to train at higher weights and greater speeds.

Since the frictionless turntable 20 is weighted around its periphery (with any desired amount of weight), it creates a flywheel effect when in motion. Consequently, the force with which the user initiates the exercise is increased through momentum. At the end of each arc, the user must work to stop the turntable 20 and to more or less quickly initiate movement in the opposite direction. This abrupt stop-and-reverse action develops the torso muscles by training these muscles to react quicker and faster with greater force. Because the user is not pushing against a stack of weights, the torso building exercise machine 10 increases the torso's range of motion. The momentum of the turntable carries the user a little beyond what is achievable using other exercise machines. The optional safety brake mechanism prevents the user from hyperextending. The present invention develops flexibility in the upper body, torso, and hips. By doing the exercises at lower weights and slower speeds, one can emphasize flexibility by taking advantage of the frictionless turntable 20.

The torso building exercise machine 10 focuses on the torso through a variety of exercise positions while also working the muscles of the arms and legs. Initially, the user's torso will fatigue before the other muscle groups. Through continued use of the machine 10, this "weak link" will be brought to par with the arms and legs. Eventually, a five minute workout on the machine 10 will fatigue the arms, legs, and torso all at about the same time for a full powerful workout.

There has been a long felt need to efficiently train the torso in rotational and diagonal directions. The machine 10 strengthens a large group of muscles which have previously been difficult to train. It contributes to a stronger back which allows the user to develop power in rotational and diagonal directions. Because the machine 10 permits a full range of motion during the workout, some users who have previously had back troubles may improve their condition. The machine 10 adds a new dimension to conventional strength and conditioning programs by filling a void. It makes possible standardization in training to an important body part.

The basic exercise positions for the torso building exercise machine 10 are as follows: (1) standing facing forward; (2) standing facing backward; (3) standing bending forward at the waist; (4) sitting facing forward; and (5) sitting bending forward at the waist.

The basic workout principles for using the torso building exercise machine 10 may be briefly stated. With no added weight on the turntable 20, the machine 10 provides for (a) stretching of the trunk muscles to increase the range of rotational motion and (b) agility exercises when done at a high rate of speed. At low weights (75 to 150 pounds for example) on the turntable 20, the user can do high repetition exercises for endurance training. At high weights (300 pounds or more) on the turntable 20, the machine 10 is used primarily for strength building exercises with low repetitions.

In general, the torso building exercise machine 10 is used in the following way when standing. The pointer 38 should be lined up with the upright stanchion 50 at the 0° position. The user U should stand straddling the center of the turntable 20 with his feet fairly widely apart (about 24 to 30 inches apart). The user should keep his toes pointing straight ahead or slightly inward. The user should keep his knees minimally bent and should not lock his knees. The user should grasp the selected two upper handholds in a comfortable position.

The method of exercising on the machine 10 is to initiate the rotation of the turntable 20 from the 0° position in either direction. Then the user should stop the movement of the turntable 20 at about 90° from the starting point. The user should not rotate the turntable to the point of it bouncing off the safety brake cord 44. The user should immediately reverse the turntable 20 in the other direction through an arc of about 180°, i.e., about 90° to the other side of the starting point. The user should then continue rotating the turntable 20 clockwise and counterclockwise until fatigued.

Three specific exercises are now described, simply by way of example. The first exercise is where the user is standing facing forward as shown in FIG. 2. The user stands upright and grasps selected upper handholds widely. Bracing the forehead against the cushion strip 78 on the vertical member 74, the user begins the exercise by rotating the turntable 20. The user then stops the turntable at a point approximately 90° from the starting point and immediately reverses the movement. The user continues the movement through about 180° by stopping and reversing at about 90° on the other side of the starting point. The user continues rotating back and forth until fatigued.

The second exercise involves the user standing on the turntable 20 facing backward. The user turns his body so that he is in a position 180° from that assumed in the previous exercise. The user is facing away from the stanchion 50 while the pointer 38 remains lined up with the upright stanchion 50. The user then reaches up behind himself and grasps two selected upper horizontal 80–94 or the near-vertical brace members 96, 98 as desired. The user tilts his head back until it is securely braced against the vertical member 74. The user then rotates the turntable back and forth as described above in the first exercise.

The third exercise on the machine 10 involves the user bending forward at his waist or sitting on seat 22. Bending forward, the user grasps two of the intermediate horizontal handholds 58, 60, 64, 66. Bending the knees minimally, the user begins the exercise by rotating the turntable 20. The user then stops and immediately reverses the turntable 20 as described above in the first exercise.

Building stronger muscles through exercise involves fatigue of the muscles. Three variables (resistance, rate and repetition—known as the three "R"s) determine the exercise intensity and the point at which fatigue is reached. Thus, the resistance (the amount of weight that must be overcome) and the rate (the speed at which the exercise is done—usually measured in exercises per minute) will determine how many repetitions one can do until fatigued. Traditionally, athletes focusing on increasing strength attempt to do exercises requiring high resistance and few repetitions (approximately 10 for example) to achieve fatigue. Athletes concentrating on endurance choose exercises with a lower resistance and more repetitions (approximately 20 or more, for example) to achieve fatigue. Athletes desirous of obtaining speed and power attempt to do exercises at a rate equal to or greater than their performance rate during the sporting activity.

Exercise machines according to the present invention allow a user to vary the resistance, to vary the rate, and to vary the number of repetitions required to achieve fatigue, and thus have a universality in the design of an exercise program. Prior to the beginning of an exercise, the user has but to select the specific weight (resistance) to be used on the turntable. The rate and number of repetitions are determined in the actual conduct of the exercise. Because the turntable is frictionless, the user must provide the energy to start and stop rotational movements. Whatever effort is expended to initiate rotation must be matched by a corresponding amount of effort to successfully stop rotation. This responsive resistance permits each user to establish and maintain an appropriate exercise intensity consistent with his physical condition. In addition, the flywheel effect increases the effective resistance of the turntable to further challenge the user.

Although the present torso builder focuses attention on the torso and rotational muscles of the midsection of the body, the fact that the muscles of the body from the feet through the arms and head are being used in unison to start, stop and reverse the machine, gives the whole body a workout rather than focusing on a single isolated specific muscle or muscle group. Physiologic working of the muscles in conjunction with one another is more natural for an athlete than isolating single muscles for separate exercises.

As will be apparent to those skilled in the art to which the invention is addressed, the present invention may be embodied in forms other than those specifically disclosed above without departing from the spirit or essential characteristics of the invention. The particular embodiments of the torso building exercise machine, as described above, are therefore to be considered in all respects illustrative and not restrictive, with the scope of the present invention being set forth in the appended claims rather than being limited to the foregoing description.

What is claimed is:

1. A torso building exercise machine comprising:

(a) a stationary base means;

(b) a horizontally disposed generally circular rotatable turntable means mounted generally centrally of said base means, said turntable means having a single degree of freedom about its vertical axis;

(c) adjustable weight means located near the periphery of said turntable means; and (d) a single upright stationary stanchion means mounted on and upstanding at one side of said base means, said stanchion means carrying a continuous, wide, curvilinear array of horizontally extending handhold means at various vertical levels at one side of said turntable means such handhold means being arranged generally concentrically of the axis of rotation of said turntable means so as to be selectively grippable by a person with arms forwardly extended while performing various torso twisting exercises on the turntable means.

2. The torso building exercise machine of claim 1, further comprising a head brace means on the stanchion which is generally centrally located with respect to said array of horizontal handhold means and inset from said array of horizontal handhold means toward the axis of rotation of the turntable means so that a user standing on the turntable means may brace his head against said head brace means while gripping selected horizontally separated handholds on said array of handhold means and while rotating said turntable means clockwise and counterclockwise with his feet and lower body.

3. The torso building exercise machine of claim 2, wherein said handhold means are at varying lateral distances from the axis of rotation of the turntable means and from the shoulders of the user when the user is positioned with his feet on said turntable means with his forehead against said head brace means.

4. The torso building exercise machine of claim 1 wherein said array of horizontal handhold means comprises a fixed, generally upwardly diverging array of horizontally extending curvilinear handholds at various distances from the axis of rotation of the turntable means.

5. The torso building exercise machine of claim 1, further comprising safety brake means including a flexural element placed rearwardly on said base means below said turntable means and post means descending from said turntable means at selected locations thereon.

6. The torso building exercise machine of claim 1, wherein said array of horizontal handhold means comprises a series of curvilinear handhold bars which substantially occupy arcs of circles concentric with the vertical axis of rotation of said turntable means.

7. The torso building exercise machine of claim 6, wherein the handhold array further comprises braces interconnecting the ends of the horizontally extending series of handhold bars, said braces of themselves being usable as handholds.

8. The torso building exercise machine of claim 1 further comprising seat means situated generally centrally of said turntable.

9. The torso building exercise machine of claim 8 wherein said seat means is fixed relative to said turntable.

10. A torso building exercise machine comprising:

(a) a stationary base means;

(b) a horizontally disposed rotatable turntable means mounted on said base means, said turntable means having a single degree of freedom for rotation about its vertical axis; and (c) a single upright stationary stanchion means mounted on said base means at one side of said turntable, said stanchion means carrying a wide, curvilinear array of horizontal handhold means at various vertical levels at one side of said turntable means and generally concentrically of the axis of rotation thereof so as to be selectively grippable by a person while performing various twisting exercises on the turntable means, said exercise machine further comprising head brace means on the stanchion means generally centrally located with respect to said array of horizontal handhold means and inset therefrom toward the axis of rotation of the axis of rotation of the turntable means so that the user may stabilize the upper portion of his body by bracing his head against the head brace means while gripping selected horizontally separated handholds on said array of handholds means and while rotating said turntable means back and forth with his feet and lower body.

11. The torso building exercise machine of claim 10, wherein said array of horizontal handhold means comprises a series of curvilinear handholds which substantially occupy arcs of circles concentric with the vertical axis of rotation of said turntable means.

12. The torso building exercise machine of claim 10, wherein the handhold array further comprises braces interconnecting the ends of the horizontally extending series of handholds, said braces themselves being usable as handholds.

13. A torso building exercise machine comprising, (a) a base frame;

(b) a turntable journaled for rotation on said base;

(c) a single stanchion standing up from said base frame at one side of said turntable;

(d) handhold means on said stanchion comprising plural, horizontally extending bars in curvilinear array at various levels from about chest height to above the head of a user and spanning about 120° of turntable rotation so as to be graspable by a user standing on the turntable with arms forwardly extended and spread apart; and (e) substantially vertically extending head brace means situated generally centrally of the array and inset therefrom toward the axis of rotation of the turntable, the user when standing on the turntable and in position grasping the handhold means array with arms extended and with the user's head braced against the head brace means being in a stance so that the user's upper torso is stabilized at three points as the user rotates the turntable back and forth by lower body manipulation.

14. A torso building exercise machine according to claim 13, wherein said handhold means array comprises substantially concentric, horizontally extending bars, the lower of which are relatively closer to the user on the turntable than are the upper of such bars.

15. A torso building exercise machine according to claim 14, wherein such substantially vertically extending head brace means lies well within an upwardly vertical projection of said turntable and the curvilinear array of handhold means lies outside an upwardly vertical projection of said turntable.

16. A torso building exercise machine according to claim 13, wherein such substantially vertically extending head brace means lies well within an upwardly vertical projection of said turntable and the curvilinear array of handhold means lies outside an upwardly vertical projection of said turntable.

* * * * *